US009089252B2

(12) United States Patent
Tsuchiya et al.

(10) Patent No.: US 9,089,252 B2
(45) Date of Patent: Jul. 28, 2015

(54) CLEANING ELEMENT AND CLEANING TOOL

(75) Inventors: Akemi Tsuchiya, Kagawa (JP); Yoshinori Tanaka, Kagawa (JP)

(73) Assignee: Uni-Charm Corporation, Ehime (JP)

( * ) Notice: Subject to any disclaimer, the term of this patent is extended or adjusted under 35 U.S.C. 154(b) by 1175 days.

(21) Appl. No.: 12/278,303

(22) PCT Filed: Feb. 7, 2007

(86) PCT No.: PCT/JP2007/052112
§ 371 (c)(1),
(2), (4) Date: Nov. 4, 2008

(87) PCT Pub. No.: WO2007/091592
PCT Pub. Date: Aug. 16, 2007

(65) Prior Publication Data

US 2009/0165230 A1 Jul. 2, 2009

(30) Foreign Application Priority Data

Feb. 8, 2006 (JP) ..... 2006-031121

(51) Int. Cl.

| | |
|---|---|
| ***A47L 13/20*** | (2006.01) |
| ***A47L 13/10*** | (2006.01) |
| ***A47L 13/16*** | (2006.01) |
| ***A47L 13/38*** | (2006.01) |

(52) U.S. Cl.
CPC ..... *A47L 13/20* (2013.01); *A47L 13/10* (2013.01); *A47L 13/16* (2013.01); *A47L 13/38* (2013.01)

(58) Field of Classification Search
USPC ..... 15/114, 143.1, 209.1, 223
IPC ..... A47L 13/10,25/00
See application file for complete search history.

(56) References Cited

U.S. PATENT DOCUMENTS

| | | | | |
|---|---|---|---|---|
| 3,066,344 | A | 12/1962 | Borrás | |
| 2005/0144749 | A1* | 7/2005 | Yamada | 15/226 |
| 2007/0028409 | A1* | 2/2007 | Yamada | 15/226 |

FOREIGN PATENT DOCUMENTS

| | | | |
|---|---|---|---|
| DE | 19835735 | | 2/2000 |
| GB | 126138 | | 5/1919 |
| JP | 48-038306 | Y1 | 11/1973 |
| JP | 09-154791 | A | 6/1997 |
| JP | 3107950 | U | 1/2005 |
| JP | 2005-161051 | A | 6/2005 |
| JP | 2005161051 | A | 6/2005 |

(Continued)

OTHER PUBLICATIONS

English translation of Chinese First Office Action from corresponding Chinese Application No. 20078000498791, dated Feb. 12, 2010, 7 pages.

(Continued)

*Primary Examiner* — Monica Carter
*Assistant Examiner* — Stephanie Berry
(74) *Attorney, Agent, or Firm* — Brinks Gilson & Lione

(57) ABSTRACT

A cleaning tool comprises a cleaning body having such a layer structure that non-woven fabrics and fiber bundles are laminated onto each other. In the cleaning body, a hardening treatment is applied to the fiber bundles disposed in the storage space of a cylindrical part in which the holding part of a holder is stored.

8 Claims, 5 Drawing Sheets

(56) References Cited

FOREIGN PATENT DOCUMENTS

| | | | | | |
|---|---|---|---|---|---|
| WO | WO-2005/084514 | A1 | | 9/2005 | |
| WO | WO 2005/084514 | A1 | | 9/2005 | |
| WO | WO2005084514 | | * | 9/2005 | ..... A47L 13/10 |
| WO | WO 2005084514 | | * | 9/2005 | ..... A47L 13/10 |
| WO | WO 2005084514 | A1 | * | 9/2005 | ..... A47L 13/20 |

OTHER PUBLICATIONS

European Communication pursuant to Article 94(3) EPC from corresponding European Application No. 00708151.1-2316, dated Mar. 23, 2010, 3 pages.

Supplementary European Search Report from corresponding European Application No. 07708151.1-2316, dated Mar. 5, 2010, 3 pages.

* cited by examiner

CLEANING ELEMENT AND CLEANING TOOL

CROSS REFERENCE TO PRIOR APPLICATION

This is a U.S. national phase application under 35 U.S.C. §371 of International Patent Application No. PCT/JP2007/052112 filed Feb. 7, 2007 and claims the benefit of Japanese Application No. JP2006-031121 filed Feb. 8, 2006. The International Application was published in Japanese on Aug. 16, 2007 as International Publication No. WO 2007/091592 under PCT Article 21(2), the content of which is incorporated herein in its entirety.

FIELD OF THE INVENTION

The present invention relates to a cleaning tool, and more particularly to a cleaning tool having a cleaning element for cleaning a surface to be cleaned inside a room or a vehicle.

BACKGROUND OF THE INVENTION

Various types of cleaning tools having a sheet-type cleaning element for wiping a surface to be cleaned are known. For example, Japanese non-examined laid-open Patent Publication No. 9-154791 discloses a cleaning tool having cleaning fabric and a holder that detachably holds the cleaning fabric inserted into a holding space of the cleaning fabric. This cleaning tool is capable of wiping a surface to be cleaned by using the cleaning fabric held via the holder. However, in designing a cleaning element or a cleaning tool of this type having the cleaning element, it is particularly required to provide an effective technique for reducing the manufacturing costs.

SUMMARY OF THE INVENTION

It is, accordingly, an object of the present invention to provide an effective technique for reducing the manufacturing costs in a cleaning tool having a cleaning element for cleaning a surface to be cleaned.

The above-described problem can be solved by the features of the claimed invention. This invention can be applied to the construction of cleaning tools for cleaning surfaces to be cleaned (floors, walls, ceilings, external walls, furniture, clothes, curtains, bedding, home electric appliances, etc.) inside and outside of houses, apartments, buildings, factories, vehicles, etc. or surfaces of human body parts to be cleaned. These surfaces to be cleaned may be either flat or curved, uneven or stepped or notched or otherwise irregular.

The cleaning element according to this invention is provided in order to solve the above-described problem. The cleaning element has a layer structure with a fiber bundle and a non-woven fabric laminated together. The cleaning element includes at least a tubular part, a receiving space, a brush part and a hardened part. The non-woven fabric in this invention has a sheet-like configuration formed by fixing or entangling fibers by mechanical, chemical or heat treatment. Typically, the non-woven fabric partly includes thermoplastic fibers and thus can be fusion bonded.

The "fibers" in this invention are elements of yarn, textile or the like and defined as being thin and flexible fibers having a substantially longer length compared with the thickness. Typically, a long continuous fiber is defined as a filament and a short fiber as a staple. Further, the "fiber bundle" in this invention is a single fiber structure formed by the above-mentioned fibers, a fiber structure having the above-mentioned fibers aligned in the length direction and/or the radial direction (twist yarn, spun yarn, yarn to which a plurality of filaments are partially connected), or an assembly of the fiber structures. Typically, the fiber bundle is formed of polyethylene (PE), polypropylene (PP), polyethylene terephthalate (PET), nylon, rayon or the like. In practical use, an assembly of filaments formed by opening a tow is frequently used as the fiber bundle.

The tubular part in this invention is a long part formed by folding back the cleaning element into a tubular shape such that the fiber bundle of the cleaning element is located inside. The sectional shape of the tubular part widely includes circular, elliptical, triangular, rectangular, polygonal and other various shapes. Further, the tubular part may have a closed section or an open section which is not completely closed.

The receiving space in this invention is defined inside the tubular part and configured as a region (space) in which a holding part for holding the cleaning element is removably received. When the holding part for holding the cleaning element is in the mounted state or in the state received in the receiving space, the cleaning element is held by the holding part. Further, the user can replace the cleaning element by removing the cleaning element from the holding part as necessary. The cleaning element according to this invention may be of disposable type designed for single use, disposable type designed for multiple use which can be used several times, while retaining dust which has been removed from the surface to be cleaned, on a brush part, or reusable type which can be reused by washing.

The brush part in this invention forms a brush-like cleaning area in a region of the cleaning element other than the tubular part. The brush part has the fiber bundle on the inner side and the non-woven fabric on the outer side (top). The brush part having such a construction is effective in sweeping away dirt and dust on the surface to be cleaned. The non-woven fabric of the brush part may be preferably configured as strips, and more preferably, the strips of the non-woven fabric may have a zigzag shape which can easily trap dust.

In a construction in which the fiber bundle is disposed in the receiving space as in this invention, it is assumed that the fiber bundle comes apart. Such an occurrence interferes with the action of inserting the holding part into the receiving space and thus impairs its usability.

Therefore, in this invention, a hardened part is provided in the cleaning element. The hardened part is formed by hardening a portion of the fiber bundle which is disposed in the receiving space. By using the hardened part to form the receiving space, the fiber bundle which inherently tends to come apart can be improved in its shape retaining property. Therefore, the holding part can be smoothly inserted into the receiving space. It is necessary for the "hardening process" here to properly prevent the fiber bundle from coming apart, irrespective of the degree of hardening of the fiber bundle. Specifically, the fiber bundle subjected to a hardening process may be in a hardened state, or may have some softness. The hardening process may be appropriately performed by heat treatment (heating, fusion bonding), application of an adhesive or other similar process. The inner wall surface of the receiving space can be subjected to this hardening process in a continuous or discontinuous manner in its entirety or in part. If the inner wall surface of the receiving space is subjected to the hardening process in part, the areas to be subjected to the process can be appropriately selected as necessary, such as end portions of the tubular part, upper and lower portions of the inner wall surface of the receiving space, and left and right portions of the inner wall surface of the receiving space.

With this construction, by provision of the cleaning element having the hardened part, the inner wall surface of the receiving space can be formed by the fiber bundle itself without using other hard material. Therefore, the number of materials forming the layer structure of the cleaning element can be reduced, so that the cleaning tool can be provided with a rational construction which in turn reduces manufacturing costs.

Further, the brush part may extend from the long tubular part extending along the extending direction of the holding part, in a direction transverse to the extending direction of the tubular part. The "extending direction of the brush part" here is defined as a direction in which fibers of the fiber bundle forming the brush part extend. It is only necessary for the extending direction of the brush part to be a direction transverse to the extending direction of the tubular part. Therefore, the extending direction widely includes not only the direction generally perpendicular to the extending direction of the tubular part, but a direction inclined at a predetermined angle with respect to the extending direction of the tubular part.

With such a construction, when the tubular part is disposed horizontally, the brush part can be arranged to extend vertically downward from the tubular part. Therefore, the fibers of the brush part can be effectively used for cleaning, so that the action of sweeping away dirt and dust on the surface to be cleaned can be easily performed.

In the above-described construction, the fiber bundle may face the side of the brush part which faces the surface to be cleaned and the tubular part is disposed on the face of the brush part which faces away from the surface to be cleaned.

With this construction, the cleaning element is provided in which the tubular part is disposed on the side of the brush part opposite to the surface to be cleaned.

The long tubular part may be bent at a predetermined point in its longitudinal direction into a U-shape such that two receiving spaces for receiving the holding part are formed in both end portions of the tubular part. By using the two receiving spaces as spaces for receiving two holding parts, a construction in which the holding parts do not easily come off the receiving spaces can be realized.

With this construction, the cleaning element can be provided in which the long tubular part is U-shaped such that two receiving spaces for receiving the holding part are formed in both end portions of the tubular part.

Further, based on this invention, a cleaning tool is provided which includes at least a cleaning element, a receiving space, a holding part and a grip part. The cleaning element further includes at least a tubular part, a brush part and a hardened part.

The cleaning element has a layer structure with a fiber bundle and a non-woven fabric laminated together. Further, the receiving space is provided in the cleaning element, and the holding part is removably received in the receiving space of the cleaning element and serves to hold the cleaning element. The grip part is connected to the holding part and designed to be held by a user.

Particularly, the cleaning element of the cleaning tool according to this invention includes a long tubular part which is formed into a tubular shape by folding back the cleaning element with the fiber bundle located inside and thus forms the receiving space, a brush part which forms a brush-like cleaning area in a region of the cleaning element other than the tubular part, and a hardened part which is formed by hardening a portion of the fiber bundle which is disposed in the receiving space.

With such a construction, by provision of the cleaning element having the hardened part, the inner wall surface of the receiving space can be formed by the fiber bundle itself without using other hard material. Therefore, the number of materials forming the layer structure of the cleaning element can be reduced, so that the cleaning tool can be provided with a rational construction which is reduced in manufacturing costs.

Further, in the cleaning tool, the extending directions of the holding part, the grip part and the tubular part may generally coincide with each other. Further, the brush part of the cleaning element may extend from the long tubular part in a direction transverse to the extending direction of the tubular part. Specifically, the brush part may extend transverse to the holding part, the grip part and the tubular part.

With this construction, when the holding part, the grip part and the tubular part are disposed horizontally, the brush part can be arranged to extend vertically downward from the tubular part. Therefore, the fibers of the brush part can be effectively used for cleaning, so that the action of sweeping away dirt and dust on the surface to be cleaned can be easily performed.

Further, the fiber bundle may face the side of the brush part of the cleaning element which faces the surface to be cleaned and the tubular part may be disposed on the face of the brush part which faces away from the surface to be cleaned.

With this construction, the cleaning tool is provided with the cleaning element in which the tubular part is disposed on the side of the brush part opposite to the surface to be cleaned.

Further, the long tubular part of the cleaning element may be bent at a predetermined point in its longitudinal direction into a U-shape such that two receiving spaces are formed in both end portions of the tubular part.

With this construction, the cleaning tool can be provided with the cleaning element in which the long tubular part is U-shaped such that two receiving spaces for receiving the holding part are formed in both end portions of the tubular part.

As described above, according to this invention, in a cleaning tool having a cleaning element for cleaning a surface to be cleaned, particularly by provision of a hardened part which is formed by hardening a portion of the fiber bundle which is disposed in the receiving space, the number of materials forming the layer structure of the cleaning element can be reduced. Thus, the cleaning element and the cleaning tool can be provided with a rational construction which is reduced in manufacturing costs.

DETAILED DESCRIPTION OF THE INVENTION

A representative embodiment of the present invention is now described with reference to the drawings. First, the structure of a cleaning tool 10 according to this embodiment is explained with reference to FIGS. 1 and 2. Surfaces to be cleaned with the cleaning tool 10 includes surfaces to be cleaned (floors, walls, windows, ceilings, external walls, furniture, clothes, curtains, bedding, lighting, home electric appliances, etc.) inside and outside of houses, apartments, buildings, factories, vehicles, etc. and surfaces of human body parts to be cleaned. These surfaces to be cleaned may be either flat or curved, uneven or stepped or notched or otherwise irregular.

Figure 1:
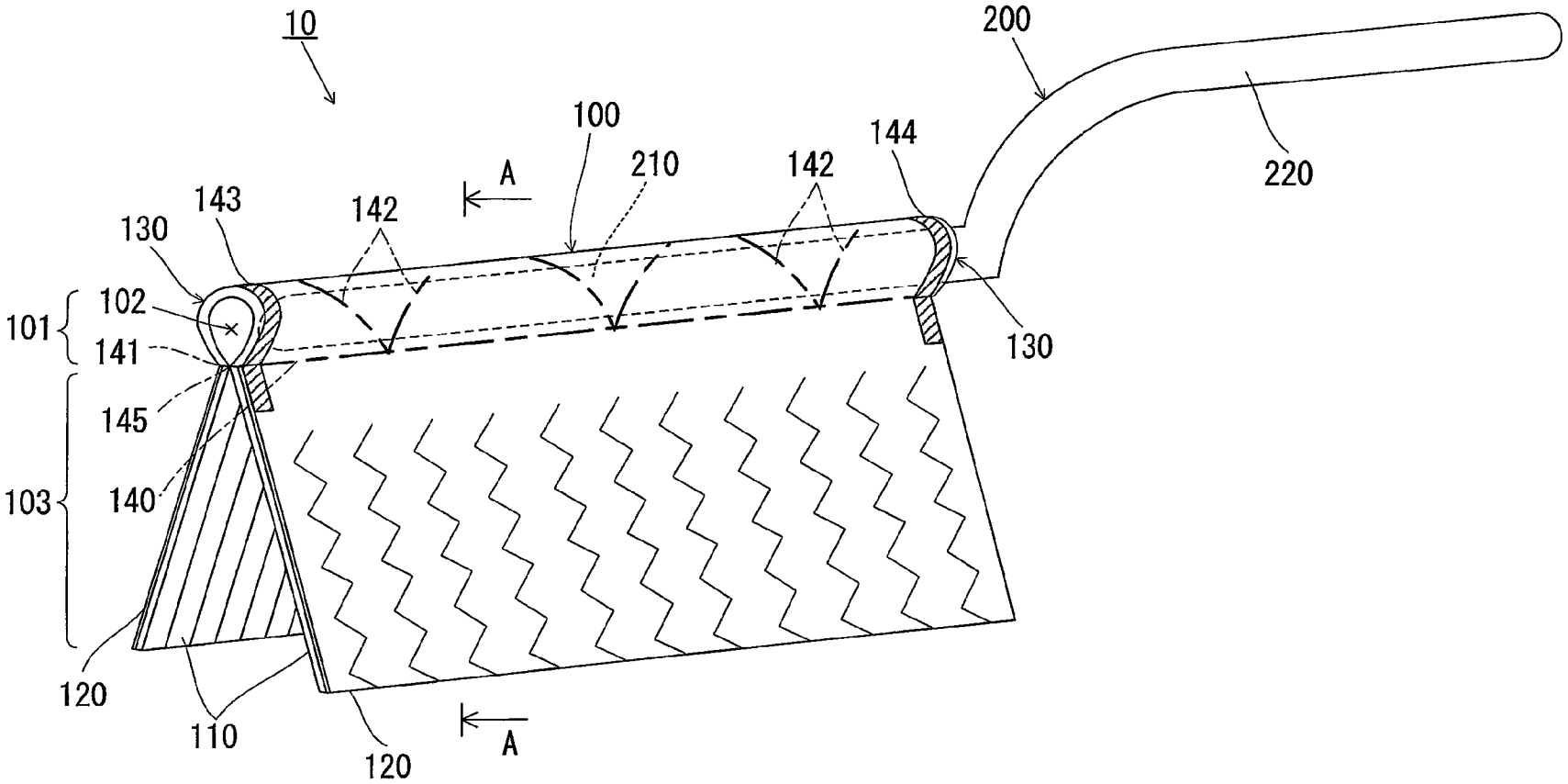
FIG. 1 is a perspective view of a cleaning tool 10 according to this embodiment of the invention.
Figure 2:
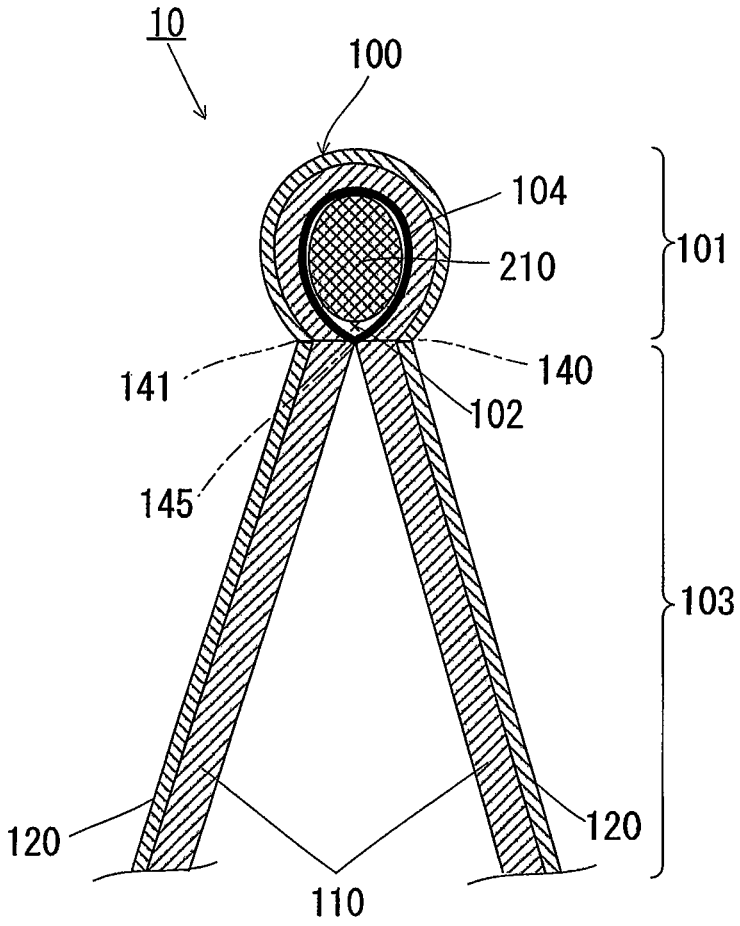
FIG. 2 is a sectional view taken along line A-A in FIG. 1.

FIG. 1 shows the cleaning tool 10 according to this embodiment in perspective view, and FIG. 2 is a sectional view taken along line A-A in FIG. 1. As shown in FIG. 1, the cleaning tool 10 comprises the cleaning element 100 and a holder 200.

As shown in FIGS. 1 and 2, the cleaning element 100 in this embodiment is formed from a sheet-type fiber bundle 110 and a sheet-type non-woven fabric 120 laminated and joined together at bonding lines 140, 141, 142, 143, 144, 145. The cleaning element 100 includes a tubular part 101 and a brush part 103. The cleaning element 100 is a feature that corresponds to the "cleaning element" according to this invention. The tubular part 101 and the brush part 103 are features that correspond to the "tubular part" and the "brush part", respectively, according to this invention. The tubular part 101 includes a hollow tubular receiving space 102 (also referred to as an "internal space"). The receiving space 102 is a feature that corresponds to the "receiving space" according to this invention. The brush part 103 forms a brush-like cleaning part in a region of the cleaning element other than the tubular part 101. Both the tubular part 101 and the brush part 103 have the fiber bundle on the inner side and the non-woven fabric 120 on the outer side (top). Further, in the cleaning element 100 in this embodiment, the fiber bundle 110 faces the side of the brush part 103 which faces the surface to be cleaned. The tubular part 101 is disposed on the face of the brush part 103 which faces away from the surface to be cleaned.

Further, in this embodiment, the brush part 103 extends vertically downward from the tubular part 101 when the holder 200 extends horizontally or a holding part 210 and a grip part 220 which are described below extend substantially horizontally. This horizontally extending state of the holder 200 coincides with the state of the holder 200 with the grip part (the grip part 220 described below) held by the user for cleaning operation. Therefore, the brush part 103 tends to extend downward, which allows full use of the fibers of the brush part 103 and is thus effective in sweeping away dirt and dust on the surface to be cleaned.

(Constriction of the Fiber Bundle 110)

The fiber bundle 110 is a single fiber structure formed by fibers, a fiber structure having fibers aligned in the length direction and/or the radial direction (twist yarn, spun yarn, yarn to which a plurality of filaments are partially connected), or an assembly of the fiber structures. The fiber bundle 110 partially includes thermoplastic fibers and can be fusion bonded. The fibers forming the fiber bundle 110 are elements of yarn, textile or the like and defined as being thin and flexible fibers having a substantially longer length compared with the thickness. Typically, a long continuous fiber is defined as a filament and a short fiber as a staple. The fiber bundle 110 is a feature that corresponds to the "fiber bundle" according to this invention. The fiber bundle 110 is typically formed of polyethylene (PE), polypropylene (PP), polyethylene terephthalate (PET), nylon, rayon or the like. In practical use, an assembly of filaments formed by opening a tow is frequently used as the fiber bundle 110. It is particularly preferable that the fiber bundle 110 comprises conjugated fibers having a core of polypropylene (PP) or polyethylene (PE) and a core covering sheath of polyethylene (PE). Further, it is preferable for the filaments of the fiber bundle 110 to have a fineness of 1 to 50 dtex, and more preferably 2 to 10 dtex. The individual fiber bundle may contain fibers of generally the same fineness or of different finenesses. Further, in order to enhance the sweeping function, it is preferred to use a fiber bundle including fibers having higher rigidity or fibers having higher fineness.

Further, flat yarns or split yarns may be employed as the fiber bundle 110. The flat yarns are prepared by slitting a film into tapes and by stretching the tapes in the longitudinal direction. The split yarns are prepared by splitting a thermoplastic film resin in the direction perpendicular to the orientation direction of the resin so that the film is fibrillated and interconnected into a net shape. Alternatively, a non-woven fabric which is bulky and has low fiber density, such as a through-air bonded non-woven fabric, may be employed to form the fiber bundle 110.

Further, preferably, the fiber bundle 110 may be formed by using crimped fibers. Here, the crimped fibers are fibers subjected to a predetermined crimping process. With the fibers being crimped, the fiber bundle becomes bulky, and dust can be easily captured by the crimped portions. This structure can be realized especially by using crimped fibers opened from a tow.

With provision of the fiber bundle 110 having the above-described construction, the cleaning element 100 in this embodiment can perform a higher cleaning function since dirt is entangled between the fibers of the fiber bundle 110 or on the crimped portions of the fibers during cleaning operation using the cleaning element 100.

(Construction of the Non-Woven Fabric 120)

The non-woven fabric 120 has a sheet-like configuration formed by fixing or entangling fibers by mechanical, chemical or heat treatment. The non-woven fabric 120 partly includes thermoplastic fibers and thus can be fusion bonded. Further, the non-woven fabric 120 has a plurality of strips. The non-woven fabric 120 is a feature that corresponds to the "non-woven fabric" according to this embodiment. The non-woven fabric 120 may be manufactured by spun bonding, through-air bonding, thermal bonding, spun lacing, point bonding, melt blowing, stitch bonding, chemical bonding, needle punching or other similar processes. In order to enhance the sweeping function in cleaning operation, it is preferred to use a non-woven fabric having higher rigidity. The strips of the non-woven fabric 120 may have various shapes, such as zigzag and curved shapes. In order to enhance the cleaning function, preferably, the strips may have a zigzag shape which can easily trap dust.

Further, as an alternative to or in addition to the non-woven fabric, urethane, sponge, woven fabric, net, split cloth or other similar material may also be used in the form of strips.

With provision of the non-woven fabric 120 having the above-described construction, the cleaning element 100 in this embodiment can perform a higher cleaning function since dust is trapped between the strips or on the faces of the strips during cleaning operation using the cleaning element 100. Further, the non-woven fabric 120 has higher rigidity than the fiber bundle 110 and thus can perform a function of preventing the fiber bundle 120 from being fixed or entangled with each other. If the non-woven fabric 120 is formed by using crimped fibers, the non-woven fabric 120 disposed on the outer surface of the tubular part 101 can also be provided with a cleaning function.

The holder 200 has a function of holding the cleaning element 100 having the above-described function and includes at least an elongate holding part 210 and an elongate grip part 220. The holding part 210 is disposed on the front end of the grip part 220. The holding part 210 is removably inserted into the receiving space 102 of the tubular part 101 of the cleaning element 100 and serves to hold the cleaning element 100. In the embodiment shown in FIG. 1, the holding part 210 is configured as one rod-like or plate-like part. The grip part 220 is connected to and extends from the rear end of the holding part 210 and held by the user's hand during cleaning operation or replacement of the cleaning element. In this embodiment, the extending directions of the holding part 210 and the grip part 220 generally coincide with each other. Further, the holding part 210 and the grip part 220 may be formed separately and assembled together. Alternatively, they may be integrally formed. The user can replace the cleaning element 100 by removing the cleaning element 100 from the holding part 210 as necessary. The cleaning element 100 may be of disposable type designed for single use, disposable type designed for multiple use which can be used several times, while retaining dust which has been removed from the surface to be cleaned, on a brush part, or reusable type which can be reused by washing.

Further, in this embodiment, the inner surface of the fiber bundle 110 which defines the receiving space 102 is subjected to a hardening process and thus forms a hardened part 104. The hardened part 104 is a feature that corresponds to the "hardened part" in this invention. By using the hardened part 104 to form the receiving space 102, the fiber bundle 110 which inherently tends to come apart can be improved in its shape retaining property. Therefore, the holding part 210 can be smoothly inserted into the receiving space 102.

Further, in this embodiment, in order to prevent the holding part 210 inserted into the receiving space 102 from easily coming off during use, stretch materials 130 are mounted on the both ends of the receiving space 102 of the tubular part 101. Each of the stretch materials 130 is a non-woven fabric at least partly including thermoplastic fiber, or a thermoplastic resin film, and is formed of materials having a stretching function, or of non-woven fabric containing a elastomer material, or of elastomer, urethane, rubber, etc.

Figure 3:
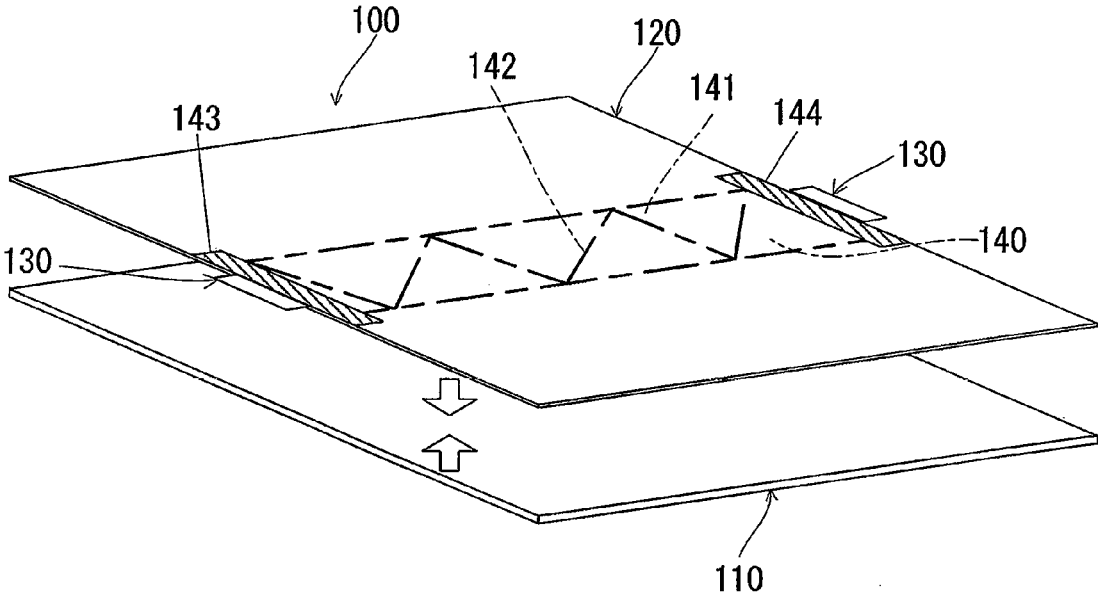
FIG. 3 shows a manufacturing process of a cleaning element 100 in this embodiment.
Figure 4:
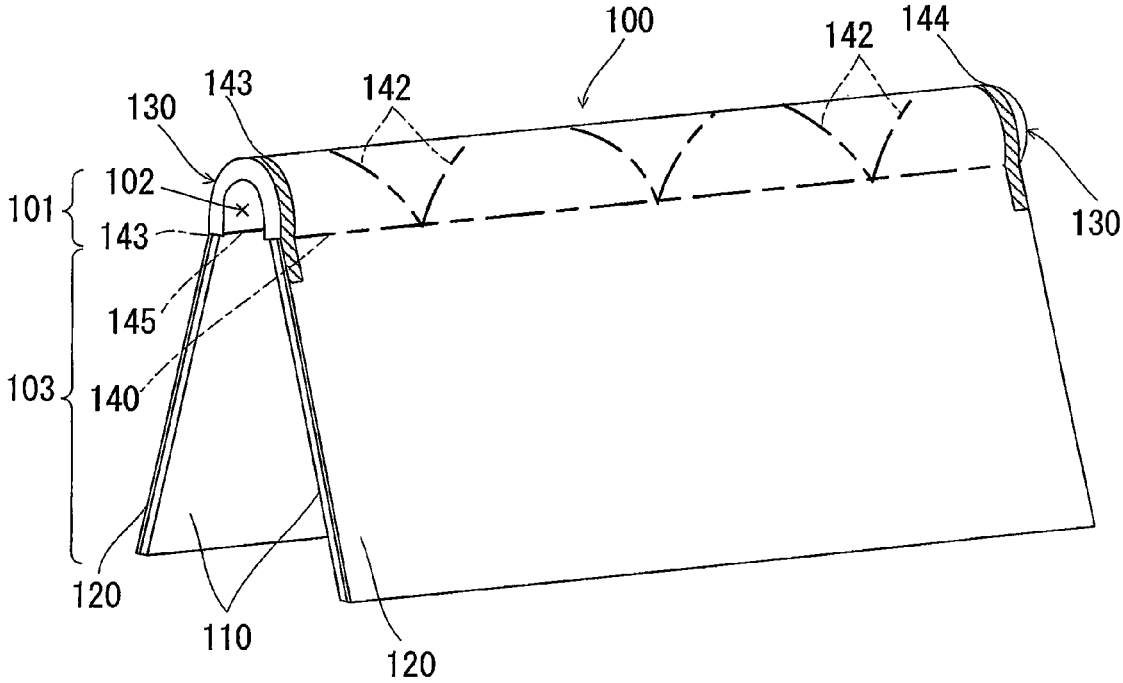
FIG. 4 shows the manufacturing process of the cleaning element 100 in this embodiment.

The method of manufacturing the cleaning element 100 having the above construction is now described with reference to FIGS. 3 and 4. FIGS. 3 and 4 show the process of manufacturing the cleaning element 100 according to this embodiment. In this manufacturing process, the cleaning element 100 shown in FIG. 1 can be manufactured at least by performing the first bonding process, the hardening process, the folding process and the second bonding process in this order.

(First Bonding Process)

As shown in FIG. 3, in this embodiment, the fiber bundle 110 having the above described construction and the strip-like non-woven fabric 120 are laminated and joined together. Specifically, the fiber bundle 110 and the non-woven fabric 120 are first fusion bonded together at the bonding lines 140, 141. Further, the fiber bundle 110 and the non-woven fabric 120 are fusion bonded in a pattern at the bonding line 142 on the portion of the fiber bundle 110 which is surrounded by the bonding lines 140, 141. The bonding line 142 can also be designed to be parallel to the bonding lines 140, 141. Subsequently, the both ends of the fiber bundle 110 and the non-woven fabric 120 are fusion bonded together at the bonding lines 143, 144. As a result, a fiber sheet of a two-layer structure consisting of the fiber bundle 110 and the non-woven fabric 120 is formed. Further, the stretch materials 130 are bonded to the both ends of the non-woven fabric 120.

(Hardening Process)

Next, the entire inner surface of the fiber bundle 110 which defines the receiving space 102 in the fiber sheet obtained by the first bonding process is subjected to a hardening process (heat treatment) and thus forms the hardened part 104. As a result, a fiber sheet of a two-layer structure consisting of the fiber bundle 110 and the non-woven fabric 120 and having the hardened part 104 is formed. The hardening process may also be performed by application of an adhesive or other similar process instead of heat treatment. Further, in this invention, the inner wall surface of the receiving space 102 can be subjected to this hardening process in a continuous or discontinuous manner in its entirety or in part. If the inner wall surface of the receiving space 102 is subjected to the hardening process in part, the areas to be subjected to the process can be appropriately selected as necessary, such as end portions of the tubular part 101, upper and lower portions of the inner wall surface of the receiving space 102, and left and right portions of the inner wall surface of the receiving space 102.

(Folding Process)

Next, as shown in FIG. 4, the fiber sheet obtained by the hardening process is folded back along the bonding lines 140, 141 in such a manner as to form a tubular shape and such that the fiber bundle 110 is located inside. As a result, a folded fiber sheet of a two-layer structure consisting of the fiber bundle 110 and the non-woven fabric 120 is formed.

(Second Bonding Process)

Thereafter, the folded portions of the folded fiber sheet obtained by the folding process are fusion bonded together at the bonding line 145. As a result, the cleaning element 100 as shown in FIG. 1 is obtained having the hollow tubular part 101 with the closed circular receiving space 102 and the brush part 103 formed in a region of the cleaning element other than the tubular part 101. Further, the bonding lines 140 to 145 may have a continuous linear or curved shape or a discontinuous linear or curved shape.

As described above, the cleaning element 100 of this embodiment is of a two-layer structure consisting of the fiber bundle 110 and the non-woven fabric 120. Therefore, the number of parts and thus the manufacturing costs can be effectively reduced.

Figure 5:
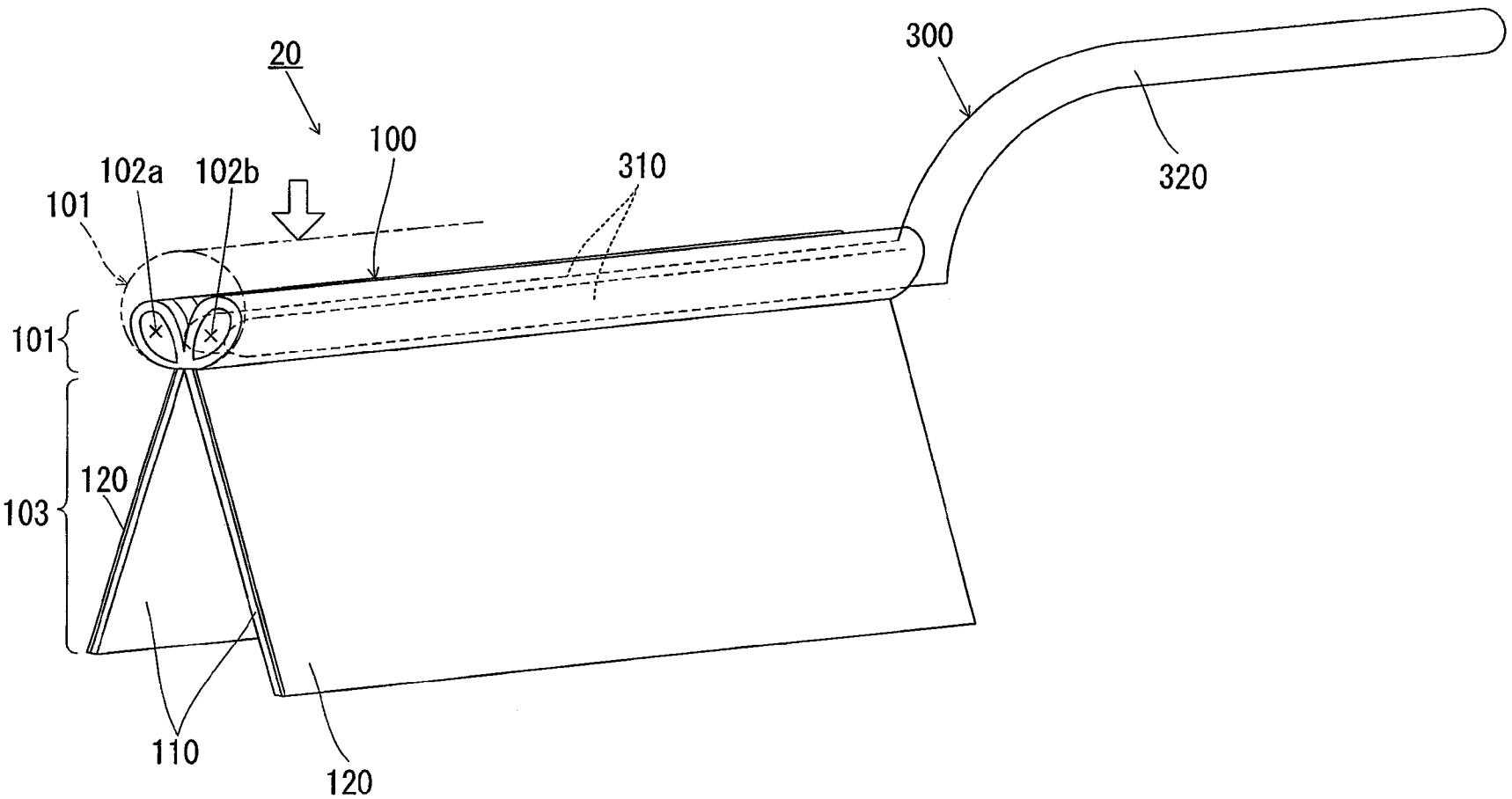
FIG. 5 is a perspective view showing a cleaning tool 20 having a holder 300 which includes a grip part 320 and two parallel holding parts 310 connected to the front end of the grip part 320.

As for the construction of the holder 200, other than the construction in which the holding part 210 is configured as one rod-like or plate-like part as shown in FIG. 1, the holder can have two or more holding parts. FIG. 5 is a perspective view showing a cleaning tool 20 having a holder 300 which includes a grip part 320 and two parallel holding parts 310 connected to the front end of the grip part 320.

When the holder 300 as shown in FIG. 5 is used, two receiving spaces must be provided in the cleaning element 100. Therefore, the tubular part 101 of the cleaning element 100 obtained in the above-described second bonding process is pressed at the top along the length of the tubular part down in the direction of the arrow in FIG. 5. Thus, the one tubular portion of the tubular part 101 is divided into two tubular portions and the pressed portion is bonded. In this manner, the cleaning element 100 can be provided with the tubular part 101 having two receiving spaces 102*a*, 102*b* as shown by solid lines in FIG. 5. The holding parts 310 (the "holding part" according to this invention) connected to the front end of the grip part 320 (the "grip part" according to this invention) are inserted into the receiving spaces 102*a*, 102*b* (the "receiving space" or the "two receiving spaces" according to this invention) of the cleaning element 100. Thus, the cleaning tool 20 (the "cleaning tool" according to this invention) shown in FIG. 5 is formed. Due to the increased number of the holding parts, the holder 300 having such a construction has an advantageous effect that the cleaning element 100 held by the holder 300 does not easily come off during use.

Figure 6:
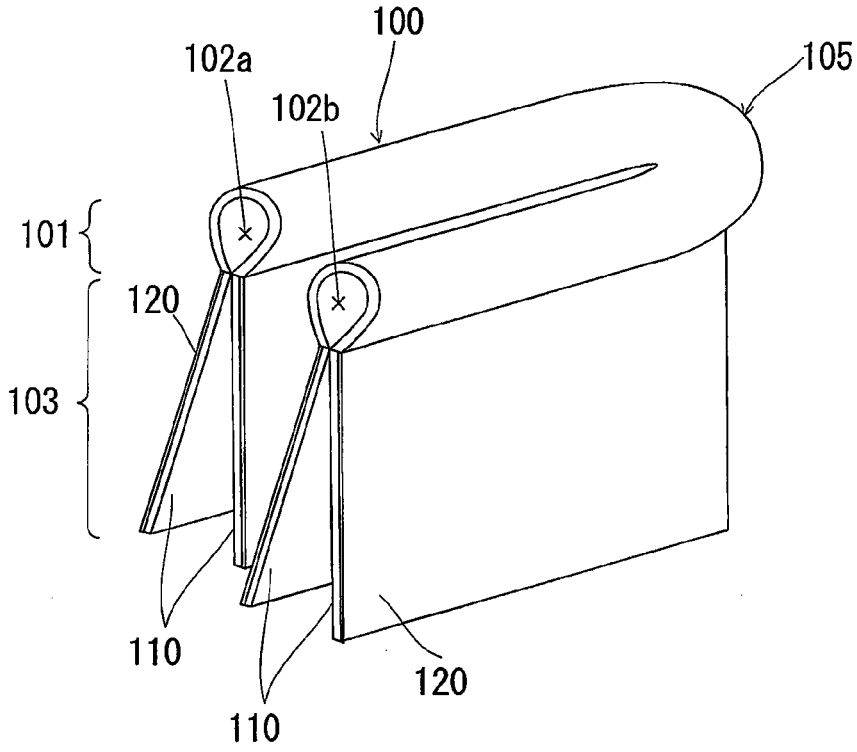
FIG. 6 is a perspective view of the cleaning element 100 formed by a different method from that of FIG. 5 and having two receiving spaces 102*a*, 102*b* in the tubular part 101.
Figure 7:
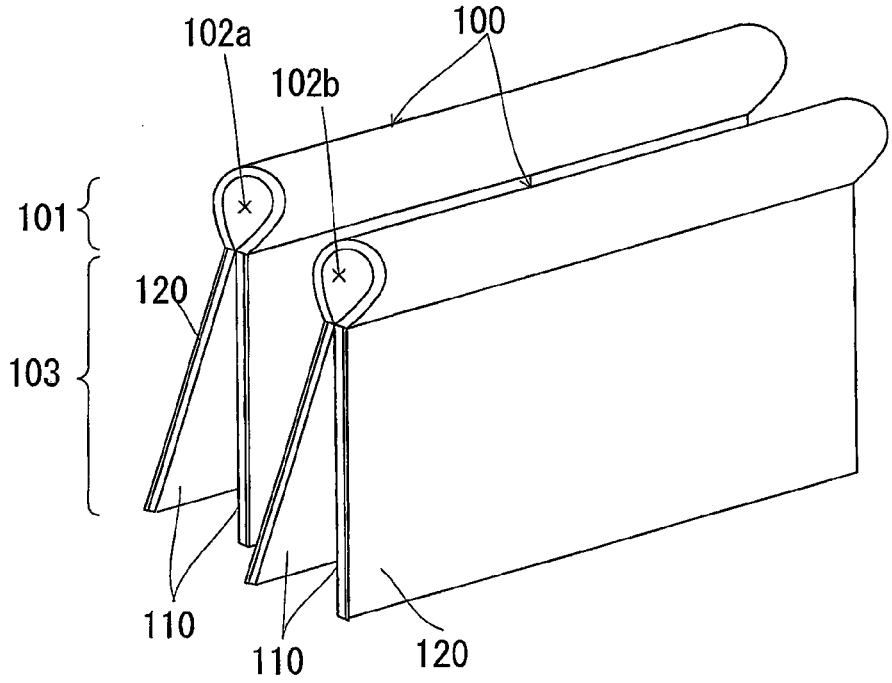
FIG. 7 is a perspective view of the cleaning element 100 formed by a different method from that of FIG. 5 and having two receiving spaces 102*a*, 102*b* in the tubular part 101.

Further, as for the method of providing the two receiving spaces 102*a*, 102*b* in the tubular part 101, as alternatives to the method of dividing the one tubular portion of the tubular part 101 into two tubular portions as shown in FIG. 5, different methods can also be used as shown in FIGS. 6 and 7. FIGS. 6 and 7 are perspective views of the cleaning elements 100 formed by different methods from that of FIG. 5 and having two receiving spaces 102*a*, 102*b* in the tubular part 101.

In the method shown in FIG. 6, the cleaning element 100 as shown in FIG. 1 is bent 180 degrees at a central region 105 so that the tubular part 101 is U-shaped. As a result, the both end portions of the tubular part 101 can be used as the receiving spaces 102*a*, 102*b*. Further, in the method shown in FIG. 7, two cleaning elements 100 as shown in FIG. 1 are provided and disposed in parallel. As a result, the receiving space of one of the cleaning elements 100 can be used as the receiving space 102*a*, while the receiving space of the other cleaning element 100 can be used as the receiving space 102*b*. The methods shown in FIGS. 6 and 7, like the method shown in FIG. 5, can achieve the effect that the cleaning element 100 held by the holder 300 does not easily come off during use. Further, by using the method shown in FIG. 7, the volume of the brush part 103 is further increased, so that the cleaning effect can be increased.

Although the cleaning element 100 in the above embodiment is described as having a two-layer structure consisting of the fiber bundle 110 and the non-woven fabric 120, it can have a multilayer structure having another fiber layer in addition to the fiber bundle 110 and the non-woven fabric. For example, a three-layer structure can be used having the fiber bundle 110 and the non-woven fabrics 120 arranged on the both sides of the fiber bundle 110. With such a construction, the fiber bundle 110 which can easily contain air between fibers is sandwiched between the non-woven fabrics 120, so that the three layer can be fusion bonded while air inside the fiber bundle 110 is squeezed out as much as possible. Thus, the fusion bonding performance can be enhanced.

Other Embodiments

The present invention is not limited to the embodiment as described above, but rather, may be added to, changed, replaced with alternatives or otherwise modified. For example, the following provisions can be made in application of this embodiment.

In the above embodiment, the brush part 103 of the cleaning element 100 is described as extending vertically downward from the tubular part 101 when the holder 200 extends horizontally. However, in this invention, various changes can be made in the extending direction of the brush part 103. For example, the brush part 103 can be inclined a predetermined angle with respect to the extending direction of the tubular part 101, or the brush part 103 can extend laterally from the both sides of the tubular part 101.

The invention claimed is:

1. A cleaning element, having a layer structure with a fiber bundle and a non-woven fabric laminated together, comprising:

a long tubular part which is formed into a tubular shape by folding back the cleaning element such that the fiber bundle of the cleaning element is located inside, a receiving space which is defined inside the tubular part and in which a holding part for holding the cleaning element is removably received, a brush part which forms a brush-like cleaning area in a region of the cleaning element other than the tubular part, and a hardened part which is formed by hardening only a surface portion of the fiber bundle in the receiving space, said hardened part extending throughout an entire length of the receiving space and being formed by heat treatment or an adhesive, wherein the fiber bundle and non-woven fabric are superimposed and each of opposite ends of both the fiber bundle and non-woven fabric are coextensive with one another and the hardened part is provided along a central portion of the fiber bundle.

2. The cleaning element as defined in claim 1, wherein the brush part extends from the long tubular part extending along an extending direction of the holding part, in a direction transverse to the extending direction of the tubular part.

3. The cleaning element as defined in claim 1, wherein the fiber bundle faces a side of the brush part which faces a surface to be cleaned and the tubular part is disposed on the face of the brush part which faces away from the surface to be cleaned.

4. The cleaning element as defined in claim 1, wherein the long tubular part is bent at a predetermined point in its longitudinal direction into a U-shape such that two receiving spaces for receiving the holding part are formed in both end portions of the tubular part.

5. A cleaning tool, comprising:

a cleaning element having a layer structure with a fiber bundle and a non-woven fabric laminated together, a receiving space provided in the cleaning element, a holding part which is removably received in the receiving space of the cleaning element and serves to hold the cleaning element, and a grip part connected to the holding part and designed to be held by a user, wherein the cleaning element includes a long tubular part which is formed into a tubular shape by folding back the cleaning element such that the fiber bundle is located inside and thus forms the receiving space, a brush part which forms a brush-like cleaning area in a region of the cleaning element other than the tubular part, and a hardened part which is formed by hardening only a surface portion of the fiber bundle in the receiving space, said hardened part extending throughout an entire length of the receiving space and being formed by heat treatment or an adhesive, and the fiber bundle and non-woven fabric are superimposed and each of opposite ends of both the fiber bundle and non-woven fabric are coextensive with one another and the hardened part is provided along a central portion of the fiber bundle.

6. The cleaning tool as defined in claim 5, wherein extending directions of the holding part, the grip part and the tubular part generally coincide with each other, and wherein the brush part of the cleaning element extends from the long tubular part in a direction transverse to the extending direction of the tubular part.

7. The cleaning tool as defined in claim 5, wherein the fiber bundle faces the side of the brush part of the cleaning element which faces a surface to be cleaned and the tubular part is disposed on the face of the brush part which faces away from the surface to be cleaned.

8. The cleaning tool as defined in claim 5, wherein the long tubular part of the cleaning element is bent at a predetermined point in its longitudinal direction into a U-shape such that two receiving spaces are formed in both end portions of the tubular part.

* * * * *